US006020031A

United States Patent [19]

Pilling et al.

[11] Patent Number: 6,020,031

[45] Date of Patent: Feb. 1, 2000

[54] CARPET MANUFACTURE

[75] Inventors: John Reginald Pilling, Worcestershire; Timothy Robert Sobey, Droitwich; Christopher John Page, Worcestershire, all of United Kingdom

[73] Assignee: Brintons Limited, Worcestershire, United Kingdom

[21] Appl. No.: 08/973,202

[22] PCT Filed: Jun. 18, 1996

[86] PCT No.: PCT/GB96/01490

§ 371 Date: Dec. 17, 1997

§ 102(e) Date: Dec. 17, 1997

[87] PCT Pub. No.: WO97/00348

PCT Pub. Date: Jan. 3, 1997

[30] Foreign Application Priority Data

Jun. 19, 1995 [GB] United Kingdom ..... 9512421

[51] Int. Cl.[7] ..... B05D 3/12

[52] U.S. Cl. ..... 427/359; 427/315; 427/316; 427/322; 427/323; 427/356; 427/368; 427/371; 427/385.5; 427/389.9

[58] Field of Search ..... 427/315, 316, 427/322, 323, 385.5, 356, 359, 368, 371, 389.9

[56] References Cited

U.S. PATENT DOCUMENTS

| | | | |
|---|---|---|---|
| 4,360,946 | 11/1982 | Marshall et al. | 15/321 |
| 4,670,317 | 6/1987 | Greenway | 428/89 |
| 4,875,249 | 10/1989 | Collier | 15/398 |
| 5,249,328 | 10/1993 | Shin | 15/182 |

FOREIGN PATENT DOCUMENTS

| | | |
|---|---|---|
| 2123981 | 9/1972 | France . |
| 53-54190 | 7/1978 | Japan . |
| 2067614 | 7/1981 | United Kingdom . |

*Primary Examiner*—Bernard Pianalto

*Attorney, Agent, or Firm*—Sughrue, Mion, Zinn, Macpeak & Seas, PLLC

[57] ABSTRACT

A method of substantially eliminating shading in a carpet by steaming the pile tufts and positively orientating the pile tufts in a predetermined direction. The positive orientation of the tufts is achieved by engagement with a scroll roll, which is preferably a smooth roller having axially or helically extending ribs or grooves.

10 Claims, 2 Drawing Sheets

CARPET MANUFACTURE

FIELD OF INVENTION

Shading has been a problem in the manufacture of carpets for many years. Shading is especially noticeable in plain and open ground carpets having a velvet pile. The cause of shading is not entirely understood but it is believed to be the result of light being reflected differently from different regions of the carpet pile to give the appearance of a watermark.

BACKGROUND ART

Numerous attempts have been made to overcome the problems of shading but so far these have met with only limited success. Indeed shading is one of the reasons why velvet pile carpets are less popular with both customers and manufacturers and the existence of problems with shading has led carpet manufacturers to offer different types of carpet such as those including a sculptured pile or a twist pile which either do not suffer from this problem or only suffer from it to a much smaller extent.

We believe the effect of shading is caused by the carpet pile tufts in some areas of the carpet being oriented at a slightly different angle with regard to the backing of the carpet from those in other areas. However, attempts to measure such angles and compare the angles in different regions where shading appears have not shown any measurable difference in their angle of orientation. Most carpet pile tufts are not placed perfectly normal to the backing and usually there is some "lay" of the pile tufts. In woven carpets this lay is caused by the tuft insertion technique and the beat-up operation. The pile tufts lay in the direction towards the already woven length of carpet and, usually to one side or the other when viewed from the already woven length of carpet.

GB-A-2,067,614 discloses a system for arranging long fibres of a material in a generally uniform direction before a treatment stage, for example dyeing, to ensure the subsequent treatment is uniformly applied to all fibres. subsequent treatment is uniformly applied to all fibres. This orientation of the fibres is achieved by brushing or combing the fibres, for example by a brush roller having fine wire bristles or using an air brush. The present inventors have found that brushing or combing the pile tufts of a carpet in this way cannot achieve uniform orientation of the tufts and does not overcome shading of the carpet.

SUMMARY OF THE INVENTION

According to this invention, substantially to eliminate shading, a carpet is subjected to a treatment in which the pile tufts are steamed and then engaged by a scroll roll which engages the pile tufts and acts positively to orientate all of the tufts into a predetermined direction, the scroll roll including one or more helical or axially extending grooves or ribs.

Preferably the anti-shading treatment is carried out immediately before coating the backing of the carpet with latex and passing it through an oven in which the latex is cured. It is believed that orienting the steamed pile with a scroll roll immediately before the carpet is heated in the latex curing oven firstly orientates the pile all in the same direction and then the heat of the curing oven dries and "sets" the pile in the oriented direction.

The peripheral speed of the scroll roll must be different to the speed of the carpet past the roll so that differential movement occurs between surface features of the scroll roll and the carpet pile to orientate it. It has been contemplated that, instead of one or more ribs, the scroll roll may include a number of raised projections.

Preferably the ratio between the peripheral speed of the scroll roll and that of the carpet past the scroll roll is such that each tuft of pile is contacted by a surface feature of the scroll roll at least twice whilst the carpet is in contact with the scroll roll.

The scroll roll may urge the pile tufts into the direction of their lay but we have found particularly beneficial results are obtained when the scroll roll urges the pile tufts in the opposite direction to their "normal" direction of lay. Whilst the mechanism by which the present invention operates is still not fully understood, explaining it in terms of plastic and elastic deformation, which is more usually used when referring to metal filaments, it would appear that when the scroll roll urges the pile tufts into their normal direction of lay some pile tufts are only bent within their normal elastic limit. Thus, whilst the scroll roll urges the carpet tufts to all lie in the same direction, because some of the tufts have only been moved through an angle less than their elastic limit, they can spring back to their original orientation before entry to the latex curing oven. However, when the pile tufts are moved from their normal direction of lay into an opposite direction of lay then in every case the pile tufts are bent beyond their elastic limit so that a permanent plastic deformation of the pile tufts results. In this way when all of the pile tufts have been plastically deformed they thereafter remain in the new direction and are thereafter set into this new direction when the carpet is cured in the latex curing oven.

DETAILED DESCRIPTION OF THE PRESENT INVENTION

Figure 1:
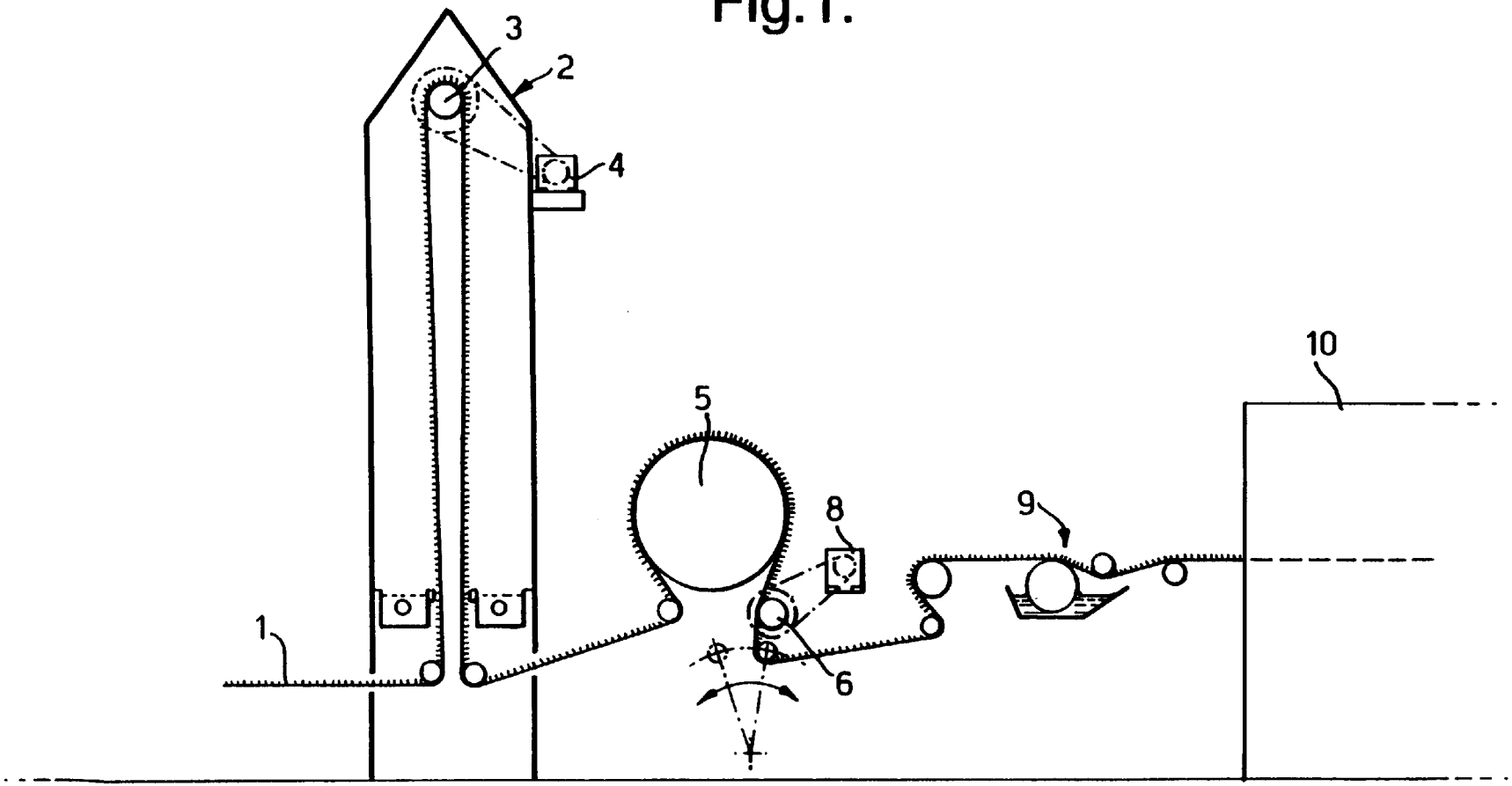
FIG. 1 shows an apparatus for eliminating shading.

In the apparatus of FIG. 1, carpet 1 is immersed in wet steam in a steam tower 2. The carpet 1 is guided through the height of the steam tower 2 about a roller 3 which is rotated by a motor 4. The path taken by the carpet 1 in the steam tower 2 ensures the carpet 1 remains immersed in wet steam for a minimum of forty five seconds, the steam pressure inside the tower being around atmospheric pressure (+3 kPa, 0.5 psi). Steam is supplied to the tower at a steam pressure of 170 to 200 kPa (25 to 30 psi).

On exiting the steam tower 2, the carpet 1 is fed around a steam drum 5. The back of the carpet 1 contacts the steam drum 5 with the tufts of the carpet 1 on the outside. The steam drum 5 contains steam which maintains the high temperature of the carpet 1 to evaporate the moisture from the carpet 1. The outer face of the steam drum has a diameter of about 900 mm and is maintained at a temperature of 135 to 140° C.

Figure 2:
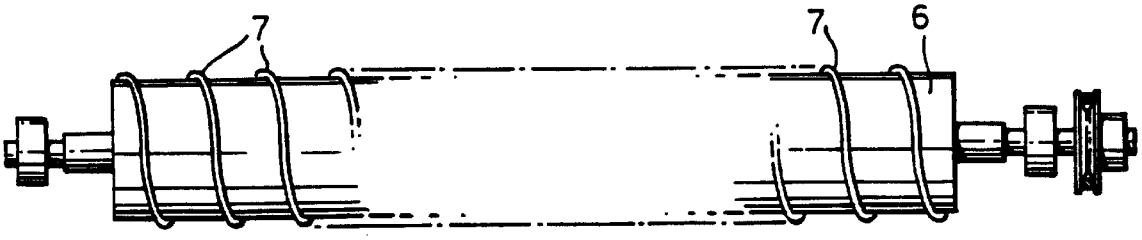
FIG. 2 shows a scroll roll for use in the apparatus of FIG. 1.

As the carpet 1 leaves the steam drum 5, the tufts on the front of the carpet 1 are engaged by a scroll roll 6 which acts to orientate all of the tufts in a pre-determined direction. As best seen from FIG. 2, the scroll roll 6 is a smooth faced roll of machined steel having a single start raised helical rib 7 extending around it along its length. This rib 7 is welded to the roll body 6. The scroll roll 6 has a diameter of about 200 mm, and the raised helical rib 7 has a height of about 6 mm, and a pitch of 150 mm.

The helical ribs 7 must move relative to the carpet 1. When the carpet passes the roller 6 at a speed of 3 m/minute, the scroll roll is rotated at a rate of about 165 rpm. This ensures that the helical ribs 7 contact each tuft at least twice as the carpet 1 passes the scroll roller 6. The scroll roller 6 is rotated by a motor 8.

After the carpet 1 has passed over the scroll roller 6, it is passed through a latex coating station 9, in which the back of the carpet 1 is coated with latex. The latex coated carpet is fed to a series of carpet drying ovens 10 to dry the carpet 1 and cure the latex. In each of the drying ovens 10, the temperature at the front of the carpet 1 is maintained at a constant temperature of 100°C. The temperature at the back of the carpet is reduced from an initial temperature of 165° C. to 115°C.

We claim:

1. A method of treating a carpet substantially to eliminate shading by subjecting the carpet to a treatment comprising the following steps:

steam treating the pile tufts of the carpet; and then contacting the pile tufts with a scroll roll having one or more helical or axially extending grooves or ribs, the contacting of the pile tufts with the scroll roll after the steam treatment acting so as to orientate all of the tufts into a predetermined direction.

2. A method according to claim 1, further comprising the step of coating the backing of the carpet with latex and passing it through an oven, in which the latex is cured immediately after orientation of the tufts.

3. A method according to claim 2, in which the ratio between the peripheral speed of the scroll roll and that of the carpet past the scroll roll is such that each tuft of pile is contacted by a surface feature of the scroll roll at least twice whilst the carpet is in contact with the scroll roll.

4. A method according to claim 3, in which the scroll roll urges the pile tufts in the opposite direction to their "normal" direction of lay.

5. A method according to claim 2, in which the scroll roll urges the pile tufts in the opposite direction to their "normal" direction of lay.

6. A method according to claim 1, in which the ratio between the peripheral speed of the scroll roll and that of the carpet past the scroll roll is such that each tuft of pile is contacted by a surface feature of the scroll roll at least twice whilst the carpet is in contact with the scroll roll.

7. A method according to claim 6, in which the scroll roll urges the pile tufts in the opposite direction to their "normal" direction of lay.

8. A method according to claim 1, in which the scroll roll urges the pile tufts in the opposite direction to their "normal" direction of lay.

9. A method of treating a carpet substantially to eliminate shading by subjecting the carpet to a treatment, during manufacture, comprising the following steps:

steam treating the pile tufts of the carpet; and then contacting the pile tufts with a scroll roll having one or more helical or axially extending grooves or ribs, the contacting of the pile tufts with the scroll roll after the steam treatment acting so as to orientate all of the tufts into a predetermined direction.

10. A method of treating a carpet substantially to eliminate shading by subjecting the carpet to a treatment comprising the following steps:

steam treating the pile tufts of the carpet; and then contacting the pile tufts with a scroll roll having one or more helical or axially extending grooves or ribs, the contacting of the pile tufts with the scroll roll after the steam treatment acting so as to orientate all of the tufts into a predetermined direction, the contacting step comprising the step of urging the pile tufts, using the scroll roll, into a direction opposite a normal direction of lay of the pile tufts; and then coating the backing of the carpet with latex and passing it through an oven, the latex being cured immediately after the tufts have been oriented.

* * * * *